US010849805B1

(12) United States Patent
de Isaza

(10) Patent No.: US 10,849,805 B1
(45) Date of Patent: Dec. 1, 2020

(54) BED

(71) Applicant: Bernadette de Isaza, Naples, FL (US)

(72) Inventor: Bernadette de Isaza, Naples, FL (US)

( * ) Notice: Subject to any disclaimer, the term of this patent is extended or adjusted under 35 U.S.C. 154(b) by 326 days.

(21) Appl. No.: 15/052,384

(22) Filed: Feb. 24, 2016

Related U.S. Application Data

(60) Provisional application No. 62/166,801, filed on May 27, 2015, provisional application No. 62/120,716, filed on Feb. 25, 2015.

(51) Int. Cl.

| | |
|---|---|
| ***A61G 7/02*** | (2006.01) |
| ***A61G 7/047*** | (2006.01) |
| ***A47C 19/22*** | (2006.01) |
| ***A47C 19/02*** | (2006.01) |

(52) U.S. Cl.
CPC ..... *A61G 7/02* (2013.01); *A47C 19/025* (2013.01); *A47C 19/22* (2013.01); *A61G 7/047* (2013.01)

(58) Field of Classification Search
CPC ..... A47C 19/00; A47C 19/021; A47C 19/025; A47C 19/22; A61G 7/00; A61G 7/02; A61G 7/047
See application file for complete search history.

(56) References Cited

U.S. PATENT DOCUMENTS 963,538 A * 7/1910 Ford ..... A61G 7/015 4/450
1,525,605 A * 2/1925 Dry ..... A61G 7/02 5/503.1
1,844,864 A * 2/1932 Saunders ..... A61G 7/02 5/604
1,903,901 A * 4/1933 Masslow ..... A61G 7/02 5/604
1,959,728 A * 5/1934 Mathis ..... A61G 7/02 254/103
2,118,261 A * 5/1938 Marzano ..... A61G 7/02 5/604
2,218,572 A * 10/1940 Dry ..... A61G 7/02 5/604
2,872,689 A * 2/1959 Fournet ..... A61G 7/02 292/238
3,345,652 A * 10/1967 Hiraga ..... A61G 7/02 12/142 R
3,757,355 A * 9/1973 Allen ..... A61G 7/02 4/300
3,943,583 A * 3/1976 Ishikawa ..... A61G 7/02 4/144.1

(Continued)

FOREIGN PATENT DOCUMENTS

| | | |
|---|---|---|
| CN | 2016067480 | 6/2008 |
| CN | 103126834 | 6/2013 |

(Continued)

OTHER PUBLICATIONS

English Language Abstract of KR 100842565 published Jul. 1, 2008.

(Continued)

*Primary Examiner* — David R Hare
(74) *Attorney, Agent, or Firm* — DLA Piper LLP (US)

(57) ABSTRACT

Systems are provided that can comprise two vertical supports for supporting a mattress. A container can be stored under the mattress. The container can comprise a diaper pad support for supporting a diaper pad.

24 Claims, 16 Drawing Sheets

(56) References Cited

U.S. PATENT DOCUMENTS 3,959,833 A * 6/1976 Burke ..... A61G 7/015 5/695
4,030,149 A 6/1977 Kato
4,334,330 A * 6/1982 Marshall ..... A61G 5/1002 4/450
4,490,865 A * 1/1985 Hamaguchi ..... A61G 7/02 4/450
4,571,759 A * 2/1986 Sasaki ..... A61G 7/02 4/478
4,631,762 A * 12/1986 Fugett ..... A61G 7/02 5/605
4,677,700 A * 7/1987 Su ..... A61G 7/02 4/420.4
4,754,508 A * 7/1988 Nishiguchi ..... A61G 7/02 4/461
5,054,136 A * 10/1991 Inagaki ..... A61G 7/0005 4/546
5,077,845 A * 1/1992 Tokunaga ..... A61G 7/02 4/237
5,327,599 A * 7/1994 Bradley, Jr. ..... A61G 7/02 5/604
5,351,349 A * 10/1994 Tsai ..... A61G 7/02 5/604
5,381,573 A * 1/1995 MacSanz ..... A61G 5/1002 4/465
5,535,464 A * 7/1996 Salonica ..... A61G 7/015 5/604
5,901,390 A * 5/1999 Williams ..... A61G 7/02 4/476
5,926,875 A * 7/1999 Okamoto ..... A61G 7/02 5/604
6,802,093 B1 * 10/2004 Pope-Brown ..... A61G 7/02 5/604
6,848,133 B2 * 2/2005 Tanaka ..... A61G 7/02 4/300.2
8,510,881 B1 8/2013 Lee
9,038,215 B2 5/2015 Al-Jafar
D783,332 S * 4/2017 Kim ..... D24/123
2010/0083441 A1 * 4/2010 Ishida ..... A61G 7/002 5/604
2011/0179571 A1 * 7/2011 Clayton ..... A61G 7/02 5/605
2017/0216116 A1 * 8/2017 Lai ..... A61G 7/02

FOREIGN PATENT DOCUMENTS

| | | |
|---|---|---|
| CN | 105012100 | 11/2015 |
| FR | 2282255 | 3/1976 |
| KR | 100842565 | 7/2008 |
| WO | WO 2008/039044 | 4/2008 |
| WO | WO 2012/0153088 | 11/2012 |
| WO | WO 2016/013805 | 1/2016 |

OTHER PUBLICATIONS

English Language Abstract of FR 2282255 published Mar. 19, 1976.
English Language Abstract of CN 2016067480 published Jun. 4, 2008.
English Language Abstract of CN 105012100 published Nov. 4, 2015.
English Language Abstract of CN 103126834 published Jun. 5, 2013.
"Electril Toilet Bidet for Bedridden Persons on Bed XR.HLJ18-02", downloaded from http://www.alibaba.com/product-detail/Electril-toilet-bidet-for-bedridden-persons_1514956985.html, printed Dec. 13, 2016.

* cited by examiner 34
33
32
31
35
36
37

38

Figures 5a-c
Uninflated cushion 51
52

53
54

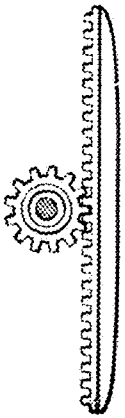
Fig. 6d
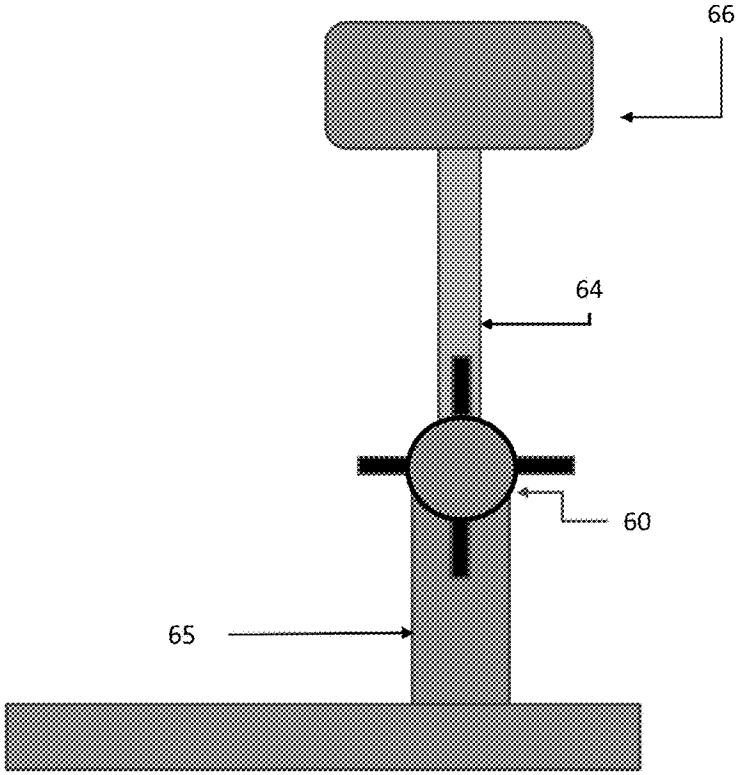
Fig. 6c
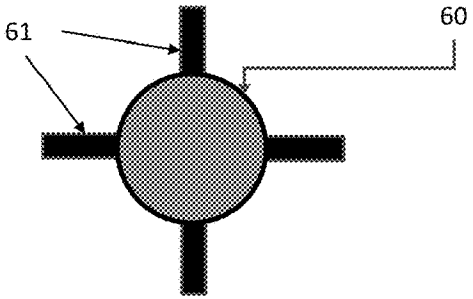
Fig. 6a
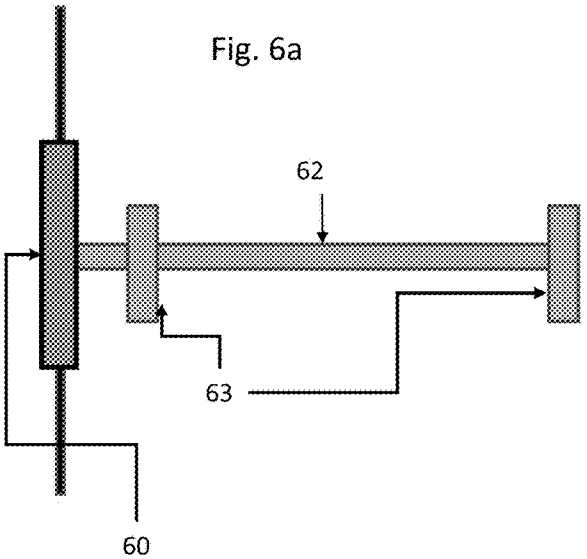
Fig. 6b – side view

BED

CROSS-REFERENCE TO RELATED APPLICATIONS

This application claims the benefit of U.S. Provisional Application Nos. 62/120,716 filed Feb. 25, 2015 and 62/166,801 filed May 27, 2015, which are incorporated by reference in their entireties.

BRIEF DESCRIPTION OF THE DRAWINGS

FIG. 6*a* shows a hand crank that can be rotated by a user to raise or lower a platform according to one embodiment.

FIG. 6*b* shows a side view of a hand crank with a shaft and pinions, according to one embodiment.

FIG. 6*c* shows a side view of an embodiment for raising or lowering a platform holding a tub or container where the hand crank rotation is translated into a linear raising or lowering motion via a rack and pinion system, according to one embodiment.

FIG. 6*d* shows a detailed view of a rack and pinion interface according to one embodiment.

DETAILED DESCRIPTION OF EMBODIMENTS

Figure 1:
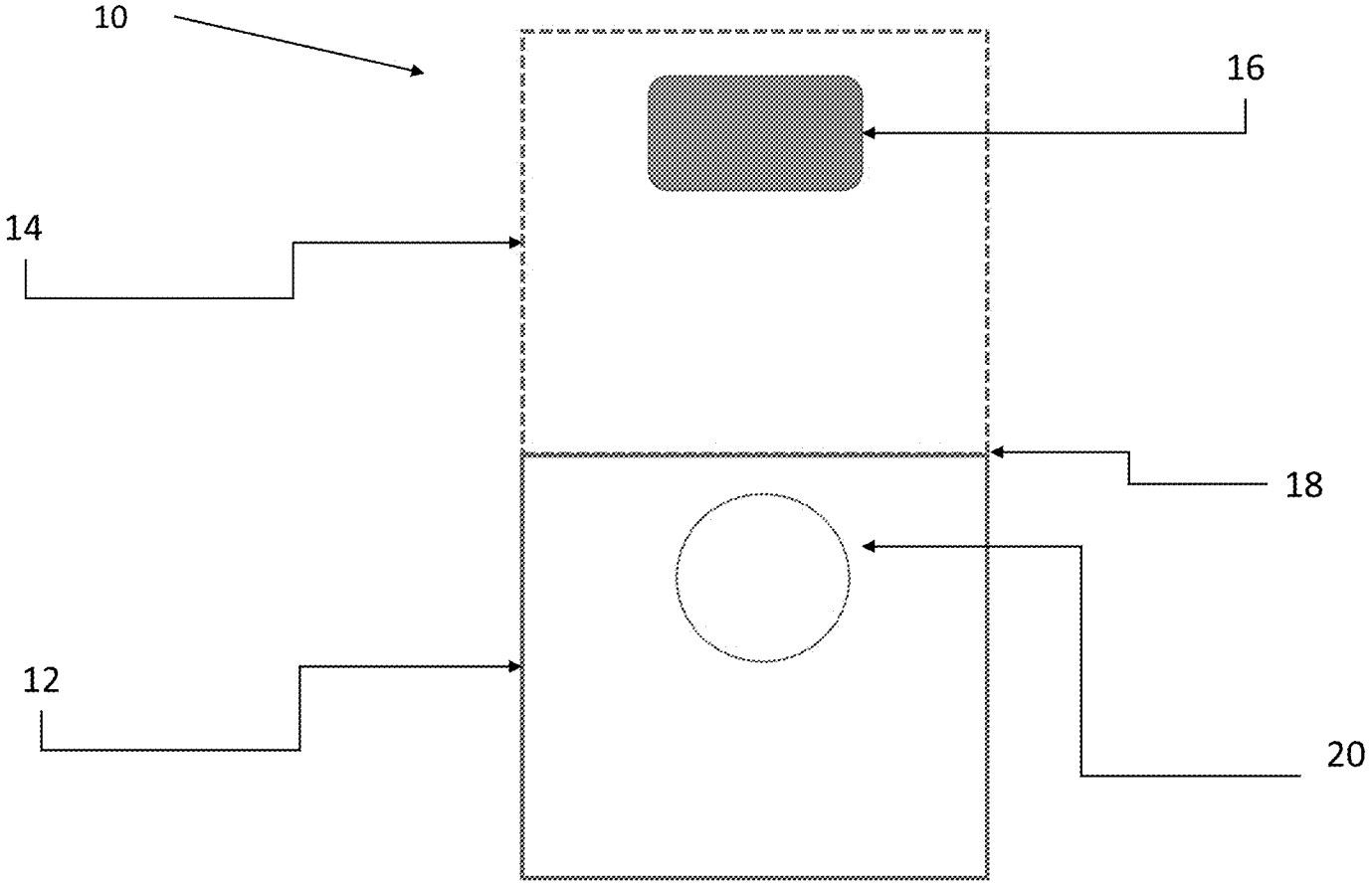
FIG. 1 shows a top view of a mattress with a circular or oval cut-out portion according to one embodiment.
Figure 2:
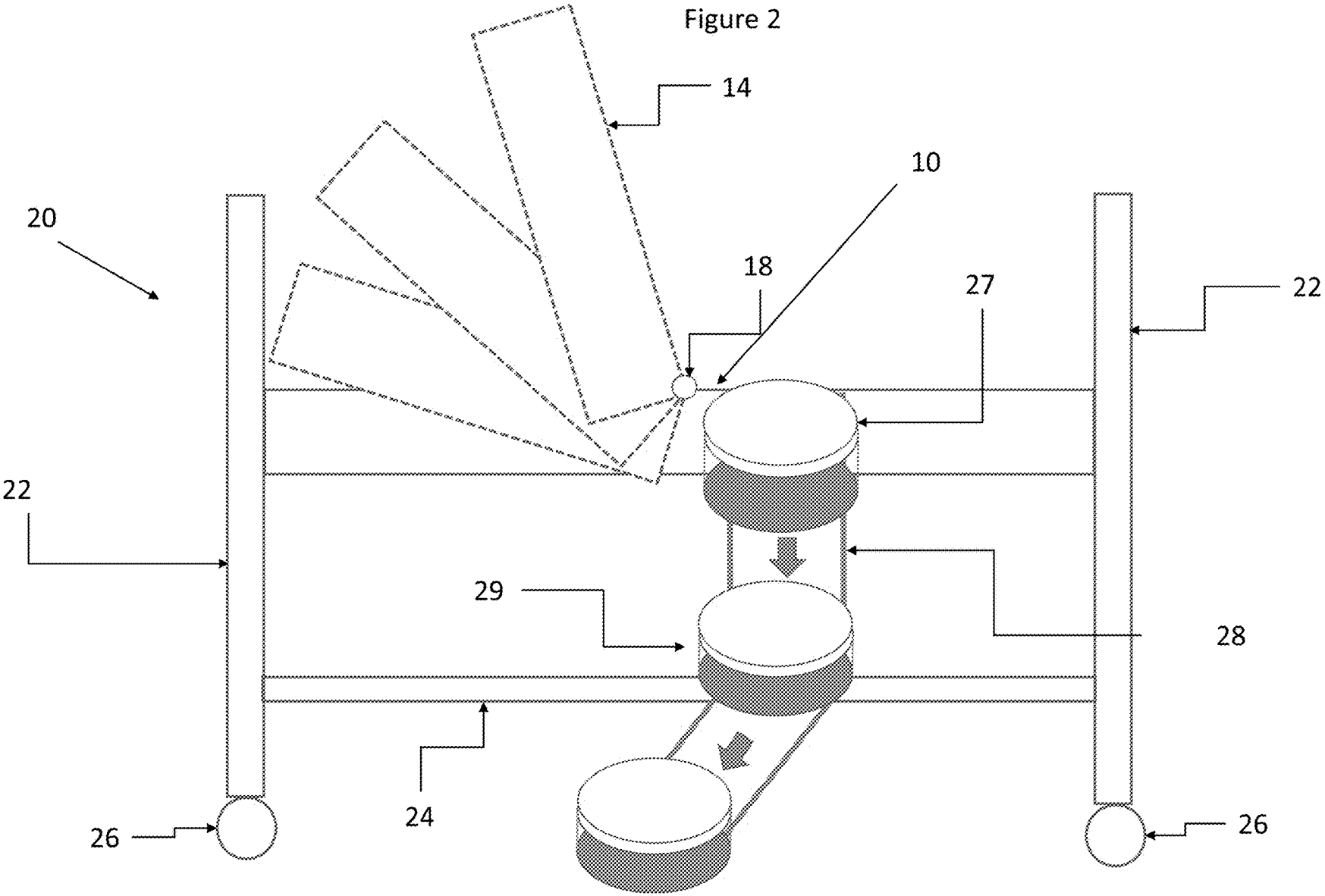
FIG. 2 shows a side view that has a mattress with a pivoting portion and a track that is configured to guide or move a container according to one embodiment.

FIGS. 1 and 2 illustrate embodiments of a mattress that has a cut-out portion and a mechanism for moving a container into or out of the cut-out portion. Alternative embodiments and additional details are also disclosed herein.

FIG. 1 depicts a top-down view of a mattress 10, according to one embodiment. The bottom portion 12 of the mattress may be fixed, and the top portion 14 may be pivotable as shown in more detail in FIG. 2. The mattress may pivot at the pivot point 18, which may be approximately at the midpoint of the mattress, although the pivot point 18 may be at other locations in the mattress. A pillow 16 may be included to provide comfort for the patient's head. The mattress can have a cut-out portion 20, which may be circular, oval, square, rectangular, polygonal, or of any other shape or configuration. The mattress cut-out portion 20 may be located at a point on the mattress roughly corresponding to where a user's genitals or buttocks would located when lying prone on the mattress. However, the location and size of the cut-out portion can be varied to accommodate different sized patients.

A patient can rest on the mattress for extended periods of time. If the patient is unable to get up and use the restroom in a normal manner, the patient may urinate or defecate into the mattress cut-out portion and/or onto the diaper pad, which is shown in more detail in FIG. 3. In some embodiments, the diaper pad may be disposable. In some embodiments, that diaper pad may sit on top of the mattress or be partially or fully insertable into the mattress.

FIG. 2 is a side view of one embodiment of the system 20 and illustrates, among other things, how the diaper pad can be removed. The system 20 may have a track 28 that can guide and move a container 29 either into or out of the mattress cut-out portion. The container can either be a toilet tub, as shown in FIG. 3, or a bidet tub with a shower insert and/or attachment, as shown in FIG. 4, or a container that functions as both a toilet tub and a bidet tub with a shower insert and/or attachment. The at least one toilet tub and the at least one bidet tub can be separate containers that are inserted in a same space such as the mattress cut-out portion. A pad and/or support 32, and/or a diaper pad 27 may be used with any of these embodiments. The diaper pad 27 may be used when one of the container's functions is a toilet tub.

The track may have a lateral extension so that the entire track forms an L-shape guide, so that the container can slide down and out for easy replacement. The track could have a series of teeth or a roller guide surface in order to interface with a complementary surface such as wheels or gears on the container and enable sliding.

Additionally, the top portion 14 of the mattress may be pivotable upwards as shown, about the pivot point 18. The mattress can pivot (e.g., up to or over ninety degrees) in order to help the patient sit up. The mechanism for inducing this pivoting motion is shown in FIG. 5. The system can also have at least two vertical supports 22 that support the mattress 10 in an elevated position.

The vertical supports 22 may also support a liquid impermeable tray 24 located beneath the mattress that serves to catch any excess fluid that escapes from above. The tray can be a rectangular shaped sheet that has generally the same shape as the mattress, though it could have a variety of other shapes. The tray may also have upturned edges around its perimeter so that it can collect a small amount of liquid without spillage. The tray could be up to six inches deep. The vertical supports 22 may also have multiple wheels 26 that make the system 20 mobile.

Figures 3A, 3B:
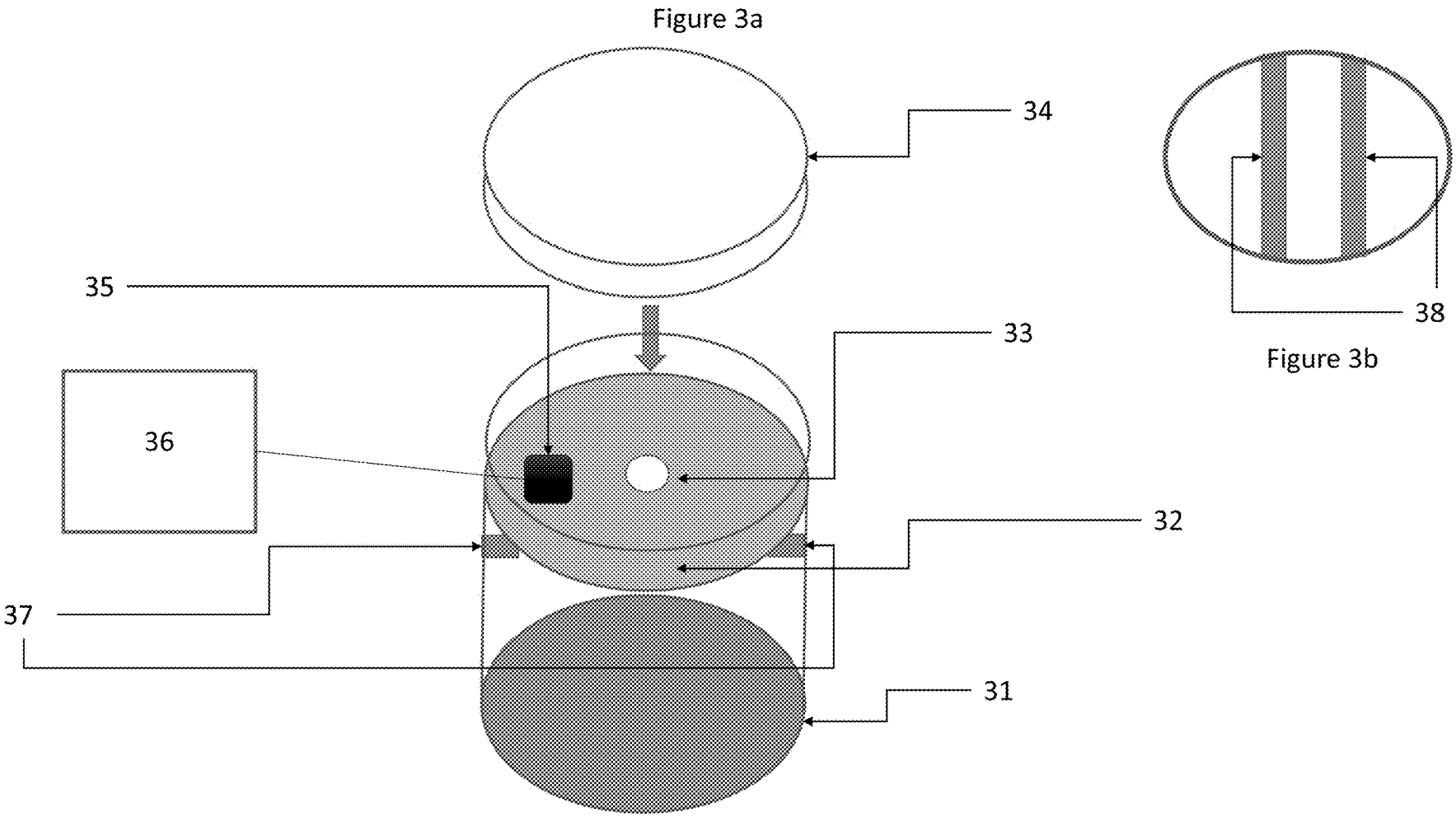
FIG. 3*a* is a detailed view of a container for holding a diaper pad according to one embodiment.
FIG. 3*b* shows a support mechanism for holding a pad/support near the top of the container according to one embodiment.

FIG. 3*a* is a detailed view of an embodiment of the container 31, which is shown as cylindrical but could be rectangular or of any other shape or configuration in cross section. The container could be of any depth that coordinated with the size of the bed. Diaper pad 34 absorbs bodily fluids such as urination excreted by the patient, as well as defecations from the patient. Container 31 and/or diaper pad 34 can be shaped to fit inside or underneath the mattress cut-out portion 20 shown in FIG. 1. The diaper pad may also be shaped to fit on top of mattress cut-out portion 20. Diaper pad 34 may also be concave. Diaper pad 34 may also be slightly mushroom shaped so as to fit over any protruding edge on the top of the container.

Pad/support 32, which may be made of plastic or any other liquid impervious material, supports the diaper pad 34 at the top of the tub. Pad/support 32 is strong enough to support a patient's weight, because a significant portion of the patient's body will weigh on the diaper pad 34. The pad/support 32 may have a drain hole 33 so that excess fluid from the patient can drain down into the bottom of the container 31. Pad/support 32 may be removable so that it can be cleaned from time to time. In some embodiments, a structural support mechanism can support the pad/support 32. For example, in some embodiments, projections 37 may extend inward on the inside of the tub in order to support the pad/support 32. As another example, in some embodiments, a structural support mechanism can be connected to and/or be a part of the container. FIG. 3*b* shows a top down view of one embodiment of such a structural support mechanism, flat crossbars 38 at the top of the container, which could be used in lieu of projections 37.

The container 31 may also have a fluid sensor 35. The fluid sensor serves to detect accumulated liquid on the pad/support 32. Control system 36 is connected to the fluid sensor and may be configured to warn nearby healthcare providers via an electronic, audio, or visual indicator that the patient has urinated or defecated and the diaper pad needs to be changed. The control system 36 can also trigger an automatic replacement of the diaper pad 34 in the automated version of the system, which is described in more detail below with respect to FIG. 11.

Figure 4A:
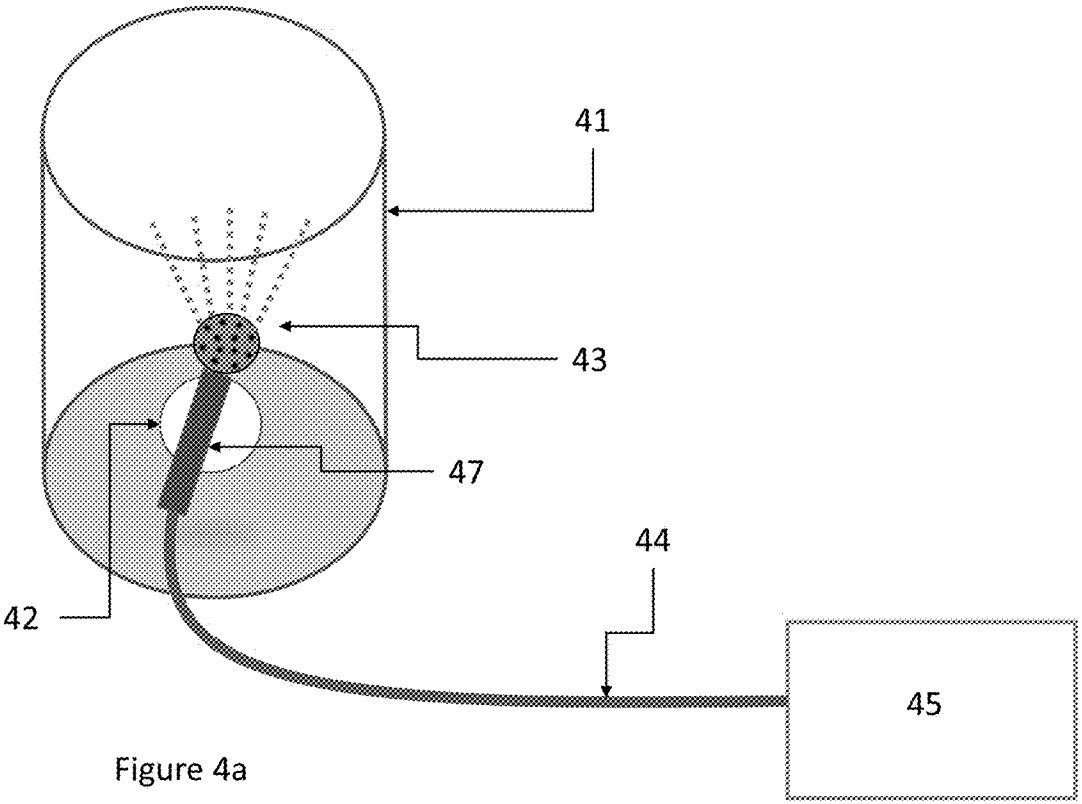
FIG. 4*a* is a side view of a container with a shower head inserted, according to one embodiment.
Figure 4B:
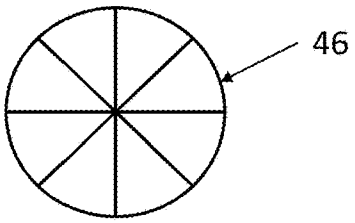
FIG. 4*b* depicts a slit valve for the side opening in the container according to one embodiment.

FIG. 4*a* is a detailed side view of an embodiment of the container with a shower insert, which is used to clean a patient who has recently urinated or defecated. The container is shown as cylindrical but could be of any other shape or configuration in cross section. This container may be shaped to fit inside or underneath the mattress cut-out portion 20 shown in FIG. 1. Container 41 can be inserted into the mattress cut-out portion after a patient has soiled the diaper pad, and the toilet tub container along with the diaper pad has been removed. Container 41 may have an open top, and it may also have a side opening 42 that is sized to allow a shower head 43 to be inserted. The side opening could include a flexible rubber slit valve 46 shown in FIG. 4*b* so that the side opening is closed when an instrument does not protrude through it. Alternatively, a mushroom-shaped screw cap could close the side opening when it is not desirable to keep it open (not shown).

The shower head receives fluid such as water from a fluid source 45 via a hose 44. The fluid source could also contain soap or antibacterial agents to improve sanitation and cleaning of the patient. The shower head 43 disperses fluid upwardly in order to wash and rinse the patient's genitals and/or buttocks after urination and/or defecation onto the diaper pad. The dirty fluid collects at the bottom of the bidet tub container 41 during cleaning. After cleaning is complete, the bidet tub container 41 along with dirty fluid is removed and the container 31 from FIG. 3 may be inserted back into the mattress cut-out portion with a fresh diaper pad 34. The shower head may have an elongated handle portion 47 that allows a user to grip and control the shower head from outside the container while it disperses water.

Figures 5A, 5B, 5C:
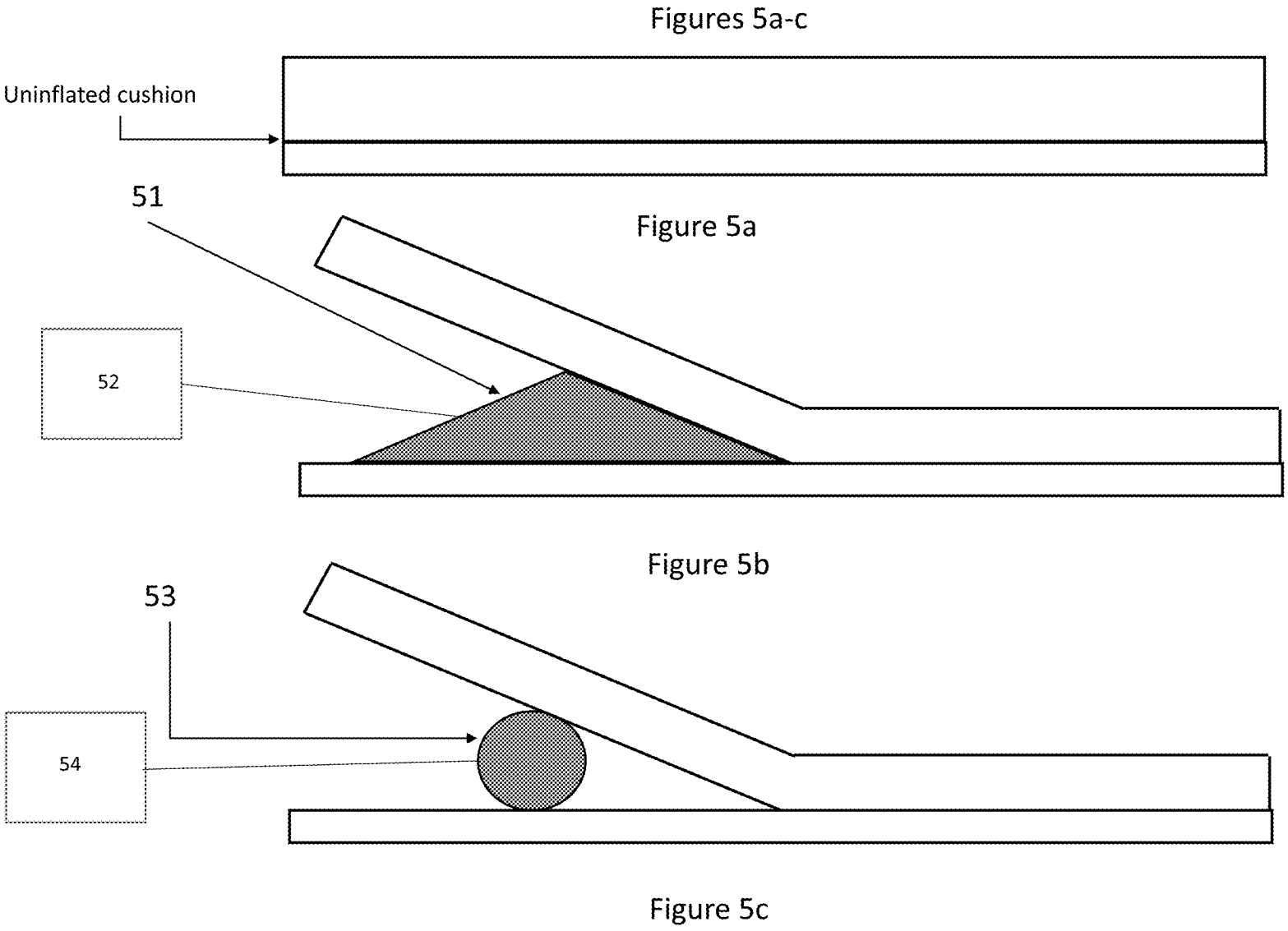
FIGS. 5*a-c* show a mattress with an uninflated cushion, an inflated cushion with a triangular cross-section, and inflated cylinder-shaped cushion, respectively, according to certain embodiments.

FIGS. 5*a-c* illustrate embodiments of an inflatable cushion that can be used to raise the top portion of the mattress. FIG. 5*a* shows the uninflated state, so no pivoting has taken place and the inflatable cushion is not visible because it is collapsed. FIG. 5*b* shows the inflatable cushion 51 after it has been inflated by an electric compressor 52. The inflatable cushion 51 has a triangular cross-section when fully inflated. FIG. 5*c* is similar to FIG. 5*b*, except that the inflatable cushion 53 is cylindrical in shape and has a roughly circular cross-section when it is fully inflated. Inflatable cushion 53 is inflated by an electric compressor 54. In both cases inflation of the inflatable cushion 53 forces the top portion to pivot upwardly, up to ninety degrees, so that a patient can sit up. The inflatable cushion may be constructed from a material that is thick and strong enough to withstand the pressure from a patient's body without rupturing when it is inflated. The inflatable cushion may be of any shape or configuration.

FIGS. 6*a-d* illustrate an embodiment of a sub-system for manually raising or lowering the toilet tub container or bidet tub. FIG. 6*a* shows a hand crank 60 with four grips 61, although any number of grips 61 could be used. FIG. 6*b* shows a side view of the hand crank with a shaft 62 extending from the hand crank and two pinions 63 on the shaft, although any number of pinions 63 may be used. FIG. 6*c* shows the assembled sub-system with a rack 64 interfacing with the pinions 63. A supporting pillar 65 guides the rack as it vertically slides. In order to raise or lower the platform 66 that holds the container, the user turns the hand crank either clockwise or counterclockwise. Rotation of the hand crank drives rotation of the pinions, which causes the rack to move vertically in one direction depending on the direction of the hand crank rotation. The container can then either be removed from the mattress cut-out portion, or moved into the mattress cut-out portion. FIG. 6*d* shows a detailed view of a rack and pinion interface 67 in order to clarify how the rack and pinion in FIG. 6*c* interface.

Figure 7:
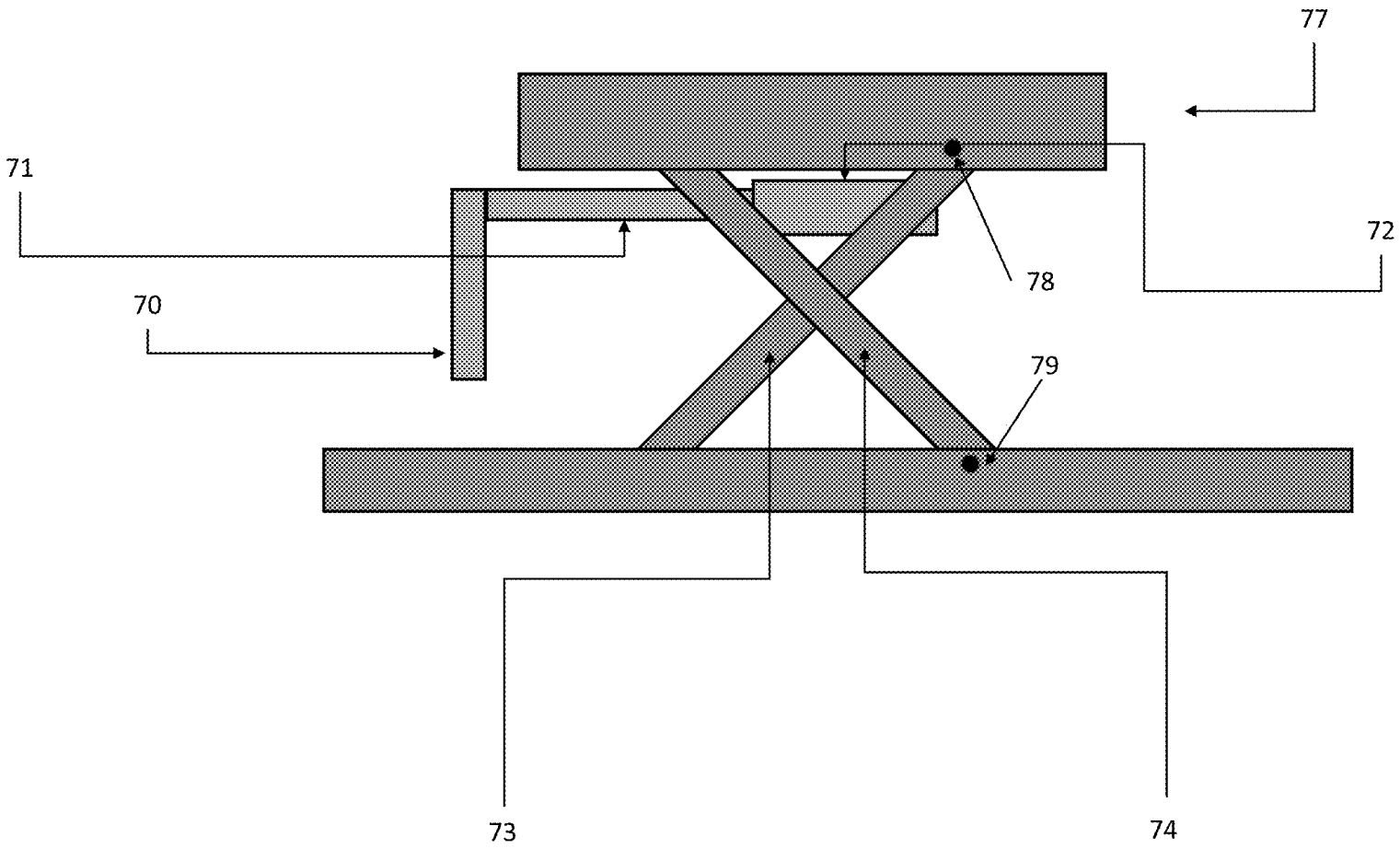
FIG. 7 shows another embodiment for raising or lower a platform that has a hand crank connected to two threaded telescoping shafts, and the shafts are connected to crossed and movable arms according to one embodiment.

FIG. 7 shows another embodiment of a sub-system for manually raising or lowering the container. Hand crank 70 is graspable by a user and is rotated either clockwise or counter clockwise. In response to this rotation, threaded inner shaft 71 will also rotate. Depending on the direction of rotation, threaded inner shaft 71 will telescope either into or out of the threaded outer shaft 72. Each threaded shaft is connected to one of the crossed arms 73, 74 so that rotation of the crank will either move the arms to a more vertical or more horizontal position, depending on the direction of rotation. The crossed arms are fixed but pivotable at points 78 and 79 and movable in a lateral and linear direction at the other side. Rotation of the crank thus either raises or lowers the platform 77 that holds the container.

Figure 8:
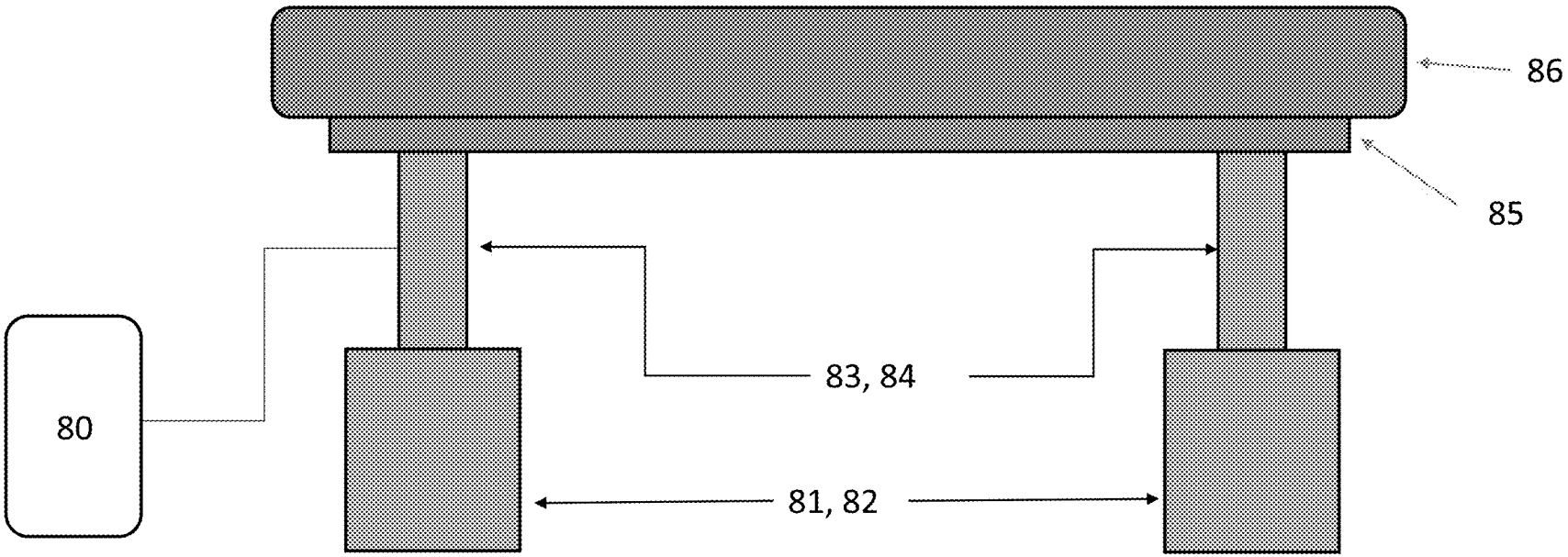
FIG. 8 shows a powered system for raising or lowering a mattress according to one embodiment.

FIG. 8 shows an embodiment of a powered sub-system for raising or lowering the mattress, which is heavier than the platform with a container. Linear actuators 83, 84 are connected to the mattress 86 through a rigid base 85, which maintains the flat shape of the mattress as it is raised or lowered. Supporting bases 81, 82 support the actuators and provide stability to the sub-system as it operates. Handheld controller 80 can be operated by a user to control the operation of the actuators, which are typically operated simultaneously to ensure that the mattress remains flat as it is raised or lowered. A user can thus raise or lower the mattress in order to facilitate manual cleaning of the patient after the patient urinates or defecates into the mattress cut-out portion. This embodiment could also be used to raise or lower the container.

Figure 9:
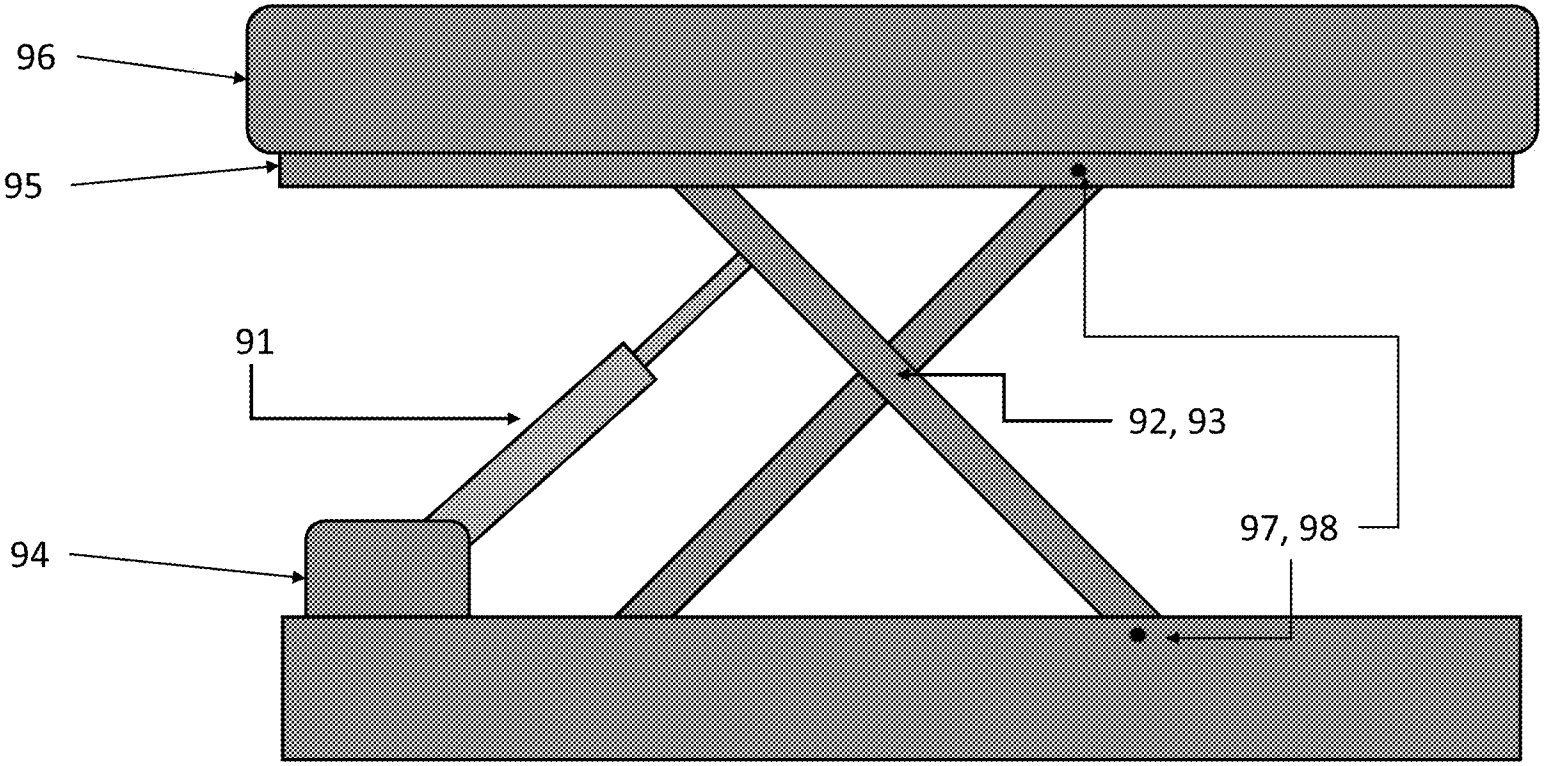
FIG. 9 shows a second powered system embodiment for raising or lowering a mattress according to one embodiment.

FIG. 9 shows another embodiment of a powered sub-system for raising or lowering the mattress. In this embodiment, only one linear actuator 91 is needed, though more could be used. The sub-system operates by way of the linear actuator 91 urging at least one of the crossed arms 92, 93 to a more vertical position, thereby raising the mattress, or by permitting it to fall to a more horizontal position, thereby lowering the mattress. The rigid base 95 again supports the mattress so that the mattress can remain flat as the forces from the actuator either raise or lower the mattress. The supporting base 94 stabilizes the linear actuator as it exerts force on the crossed arms. Pivot points 97, 98 allow the arms to pivot but not slide, but the other ends of the crossed arms are slidable in a lateral direction. This embodiment could also be used to raise or lower the container.

Figure 10:
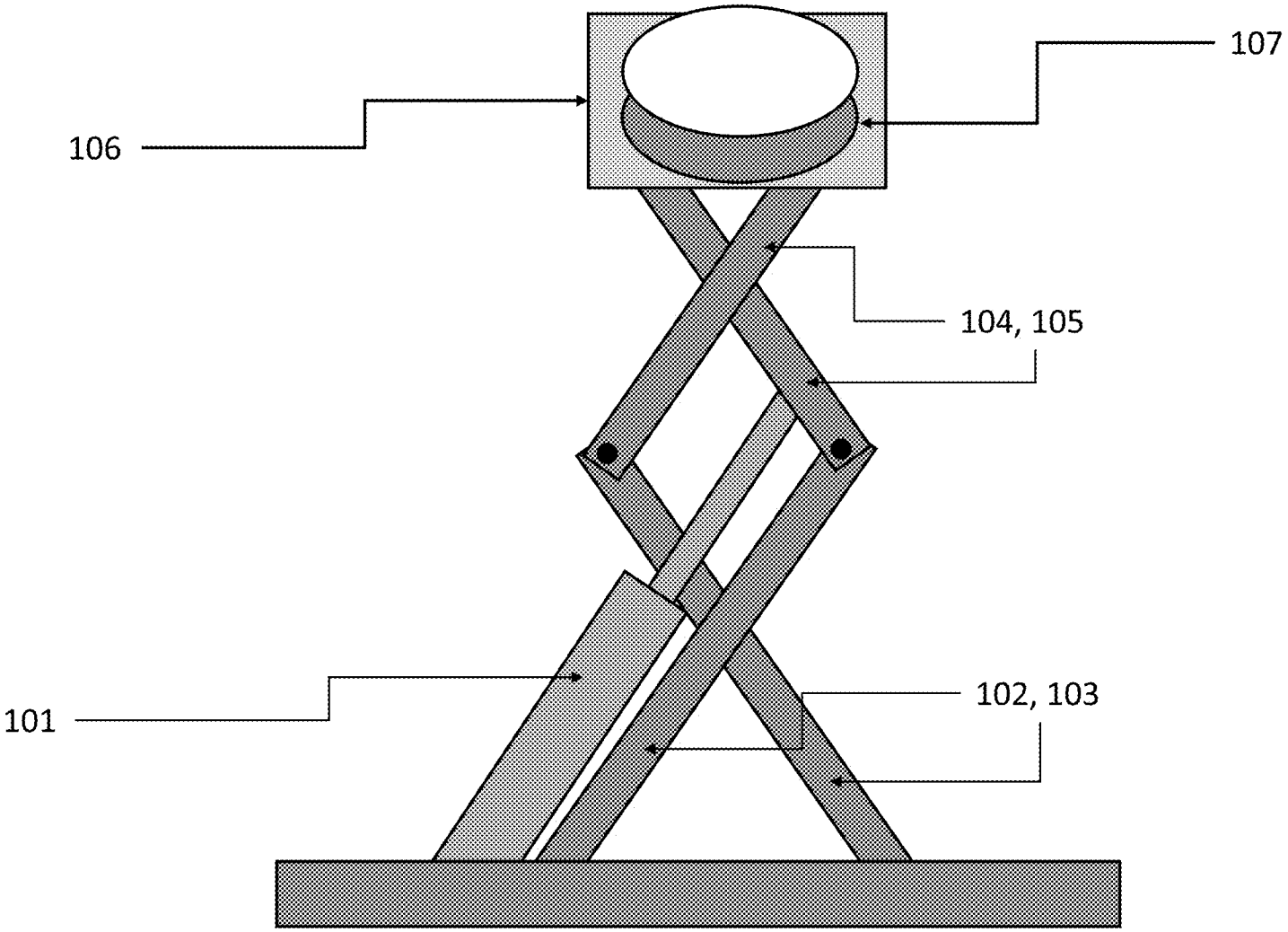
FIG. 10 shows a third powered system embodiment for raising or lowering a mattress according to one embodiment.

FIG. 10 shows another embodiment of a powered sub-system for raising or lowering the container, which could also be used to raise or lower the mattress. In this embodiment, the linear actuator urges one of the upper crossed arms 104 or 105 to a more vertical position, thereby raising the platform 106 and the container 107, or permits it to fall to a more horizontal position, thereby lowering the platform 106 and container 107. Lower crossed arms 102 and 103 support the upper crossed arms. The upper and lower crossed arms are connected via hinge connections. While only one linear actuator is shown, more than one could be used. This embodiment has a large range of motion in the vertical direction when raising or lowering.

Figure 11:
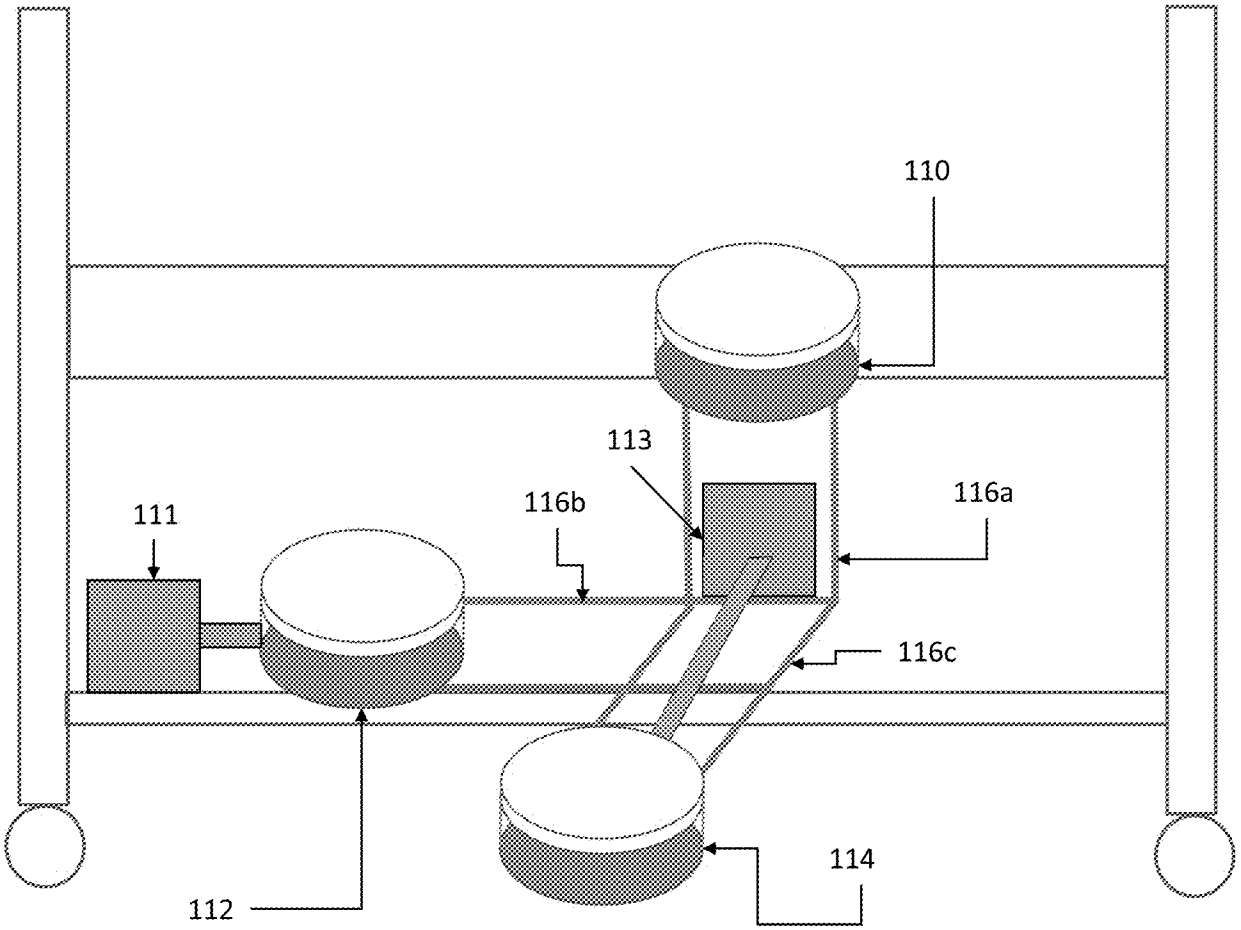
FIG. 11 shows three positions for containers where a first container with a diaper pad can be automatically replaced after it is soiled, according to one embodiment.

FIG. 11 depicts an embodiment where replacement of a container with a soiled diaper pad can be automatic when there is at least one reserve container with a fresh diaper pad. Three positions for the containers with diaper pads are shown, though more than three positions could be utilized in practice to store additional containers. In position 110, the container can support the diaper pad in or near the mattress cut-out portion. In position 112, a reserve container may be stored that can replace a container that moves out of position 110. Position 114 is a side location where the container may move to after it is moved out of position 110. In position 114, a caregiver can access and dispose of the soiled diaper pad. At least three track portions 116*a-c* are present to guide the containers to and from the various positions. Track portion 116*a* may be a vertical portion of the track for guiding containers, and track portions 116*b* and 116*c* may be horizontal.

The container initially in position 110 may be a container as shown in FIG. 3*a*. Fluid sensor 35 from FIG. 3*a* may detect fluid accumulation near the diaper pad. After detection of fluid, the control system 36 from FIG. 3*a* connected to the fluid sensor 35 can then operate a series of motors with pusher shafts or other mechanisms to guide a container with a soiled diaper pad from position 110 to position 114. Only two horizontal motors 111, 113 with pusher shafts are shown, but a third motor could be used to move the container in position 110 vertically in either direction. After the container with the soiled diaper pad moves out of the mattress cut-out portion, the control system can then operate the series of motors to guide a reserve container with a fresh diaper pad from position 112 to position 110, so that the patient has a clean diaper pad. This embodiment could also use more than 3 motors to move the containers.

The motors could be located just behind the containers so as to push the containers along the horizontal tracks via a plate or pusher mechanism, and at least one motor could raise/lower the container along the vertical track. The embodiments shown in FIGS. 8-10 could also raise or lower the containers into or out of the mattress cut-out portion. The tracks could have a series of teeth or a roller guide surface in order to interface a complementary surface such as wheels or gears on the container and enable sliding. This embodiment could also include a patient-accessible button that the patient can press to initiate replacement of the soiled diaper pad. The button could be connected to the control system 36 and be a manual trigger for replacing the container with the soiled diaper pad.

Figure 12:
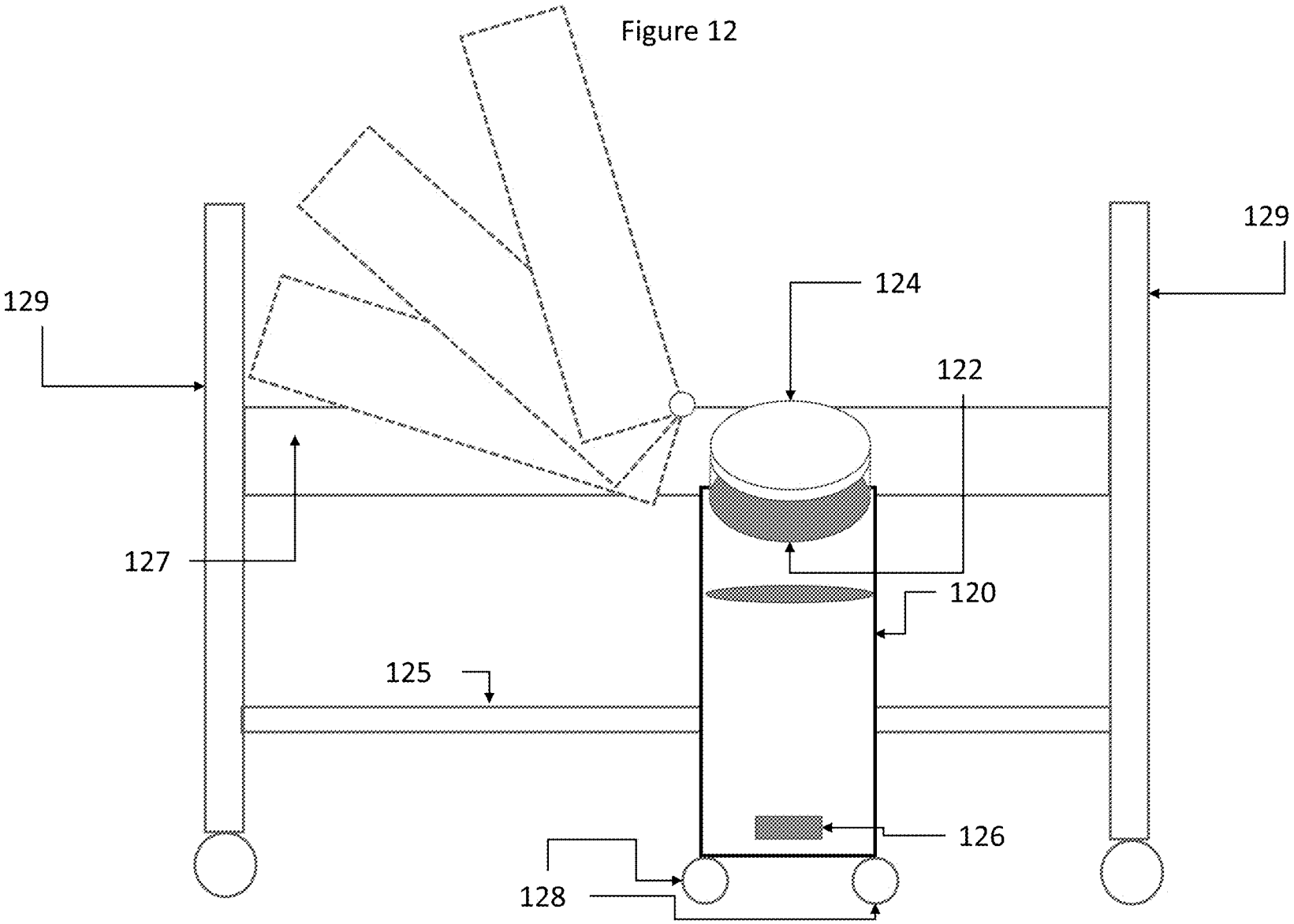
FIG. 12 shows a movable pillar unit that can insert and remove a diaper pad into a mattress cut-out portion, according to one embodiment.

FIG. 12 depicts another embodiment where a diaper pad 124 can be supported by a movable pillar unit 120. In this embodiment, the mattress 127 may also have a cut-out portion as shown in FIG. 1, and at least two vertical supports 129 may hold the mattress in an elevated position. There may also be a liquid impermeable tray 125 located underneath the mattress.

The movable pillar unit 120 may support a container 122 that holds the diaper pad 124. The movable pillar unit 120 can be made mobile through wheels 128. A foot pedal or button 128 may be depressed by a healthcare provider in order to raise or lower the container and diaper pad. In order to insert a diaper pad into a mattress cut-out portion, a healthcare provider would roll the movable pillar unit under the mattress cut-out portion and then actuate the foot pedal or button to raise the container until the diaper pad fits inside or on top of the mattress cut-out portion. When the diaper pad is soiled, the healthcare provider can actuate the foot pedal or button to lower the container until the diaper pad is below the mattress, and the movable pillar unit can then be rolled away from the mattress to a new location. In its new location, the healthcare provider can then replace the soiled diaper pad and repeat the process with a fresh diaper pad. A second pedal or button may be included for either raising or lowering the container, so that there is one pedal/button for raising and one pedal/button for lowering. Alternatively, a hand crank on the movable pillar unit could be used to raise or lower the container.

The movable pillar unit 120 can also contain at least one water tank that can be a water source for bathing and/or washing the patient. The water tank can easily be periodically refilled in a bathroom since the pillar unit is movable. This water source can be utilized through a hose, bidet style shower head, and container as shown in FIG. 4. This eliminates the need to run a hose to a faucet when cleaning the patient. A pump can be used to provide water pressure.

The container 122 can be made removable so that a container and other implements from FIG. 4*a* can be placed on the movable pillar unit in lieu of container 122 after the diaper pad 124 is soiled. As a result, a healthcare provider can easily roll the movable pillar unit 120 away from the mattress, install the container from FIG. 4*a*, move the pillar unit back under the mattress, perform bidet style cleaning, and then remove the container from FIG. 4*a* and install a container with a fresh diaper pad.

Figure 13A:
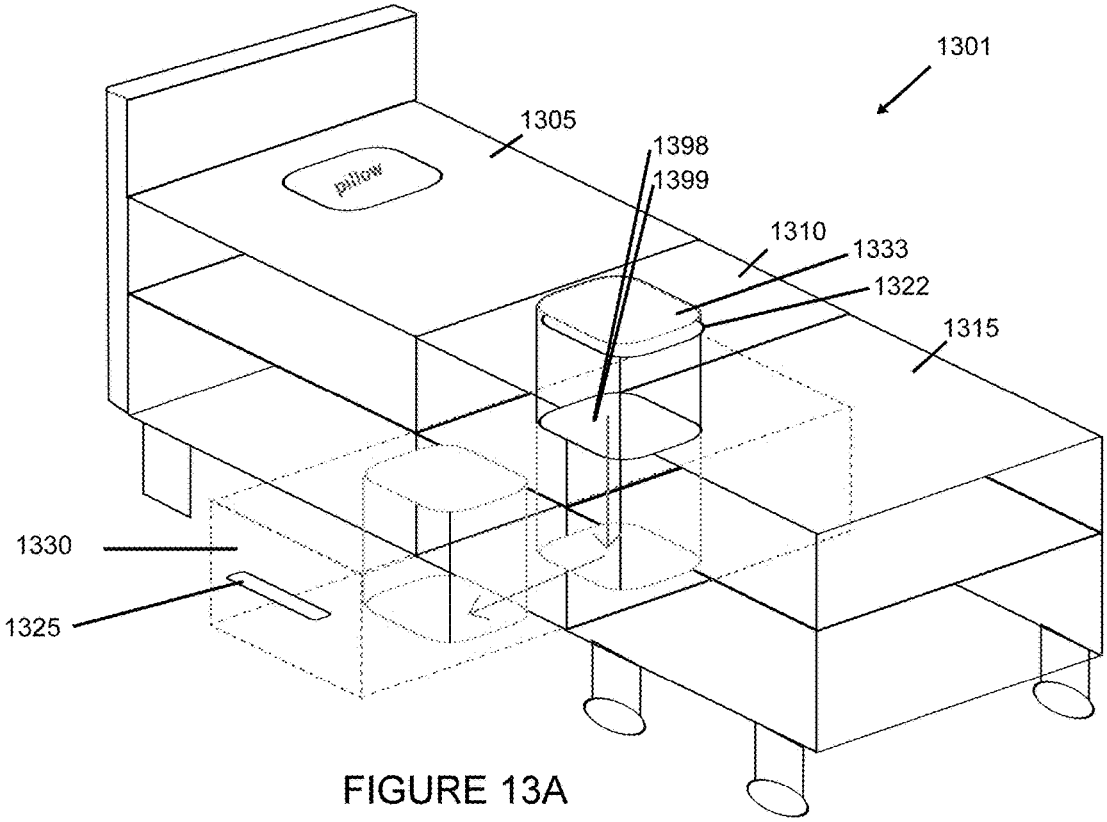
FIG. 13A illustrates an embodiment where a horizontal support for a bed may be divided into three sections.
Figure 15:
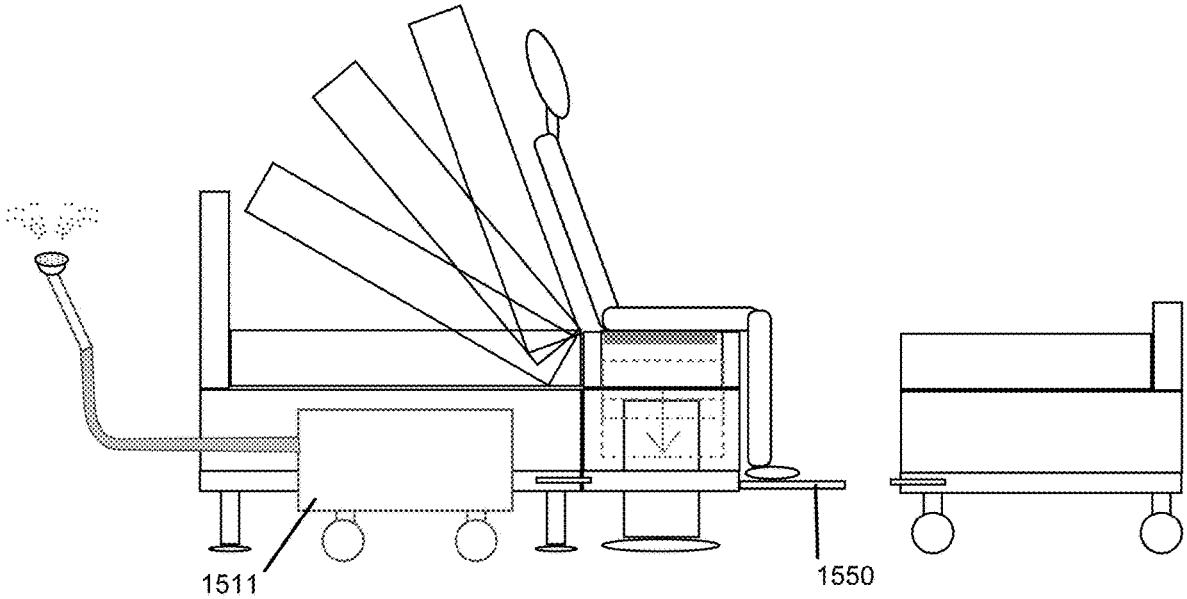
FIG. 15 illustrates an embodiment where the bottom/leg section may be unlocked and/or unhinged.

FIG. 13A illustrates another embodiment where a horizontal support 1301 for a bed may be divided into three sections: a top/torso section 1305, a middle/buttock section 1310, and a bottom/leg section 1315. Each section may be changed out, upgraded, or replaced, or any combination thereof, independent of the other sections. A mattress may also have corresponding sections to 1305, 1310 and 1315. A bidet container 1399 and/or water container 1398 may fit underneath the bed using a drawer 1330 and be rolled out and refilled. A hose or other element may be used for bathing and/or cleaning the container, which may be a bidet tub and/or a toilet tub as described above. The bidet container 1399 and the water container 1398 may be stored under the middle/buttock section 1310 in the drawer 1330. A bidet tank and/or water tank 1511 may be stored under the top/torso section 1305 (shown in FIG. 15) and/or the bottom/leg section 1315. (Note that in other embodiments, the bidet tank and/or water tank 1511 may be stored in other sections or outside the bed.) The middle/buttock section 1310 of the horizontal support and/or the mattress may have at least one cutout 1322 so that a diaper 1332 may fit in, as described above. As shown in FIG. 15, the upper portion of the horizontal support may be inclined up to 90 degrees for a sitting option. One or more wheels connected to the bed frame may enable sliding/or and swinging movement options for the horizontal support and/or the mattress.

FIG. 15 also illustrates how the bottom/leg section 1315 may be unlocked and/or unhinged, allowing it to swing or pull out, converting the bed into a sitting position. A footstand 1550 may be attached and/or pull out of the lower bed frame to support the foot of the bed.

Figure 14:
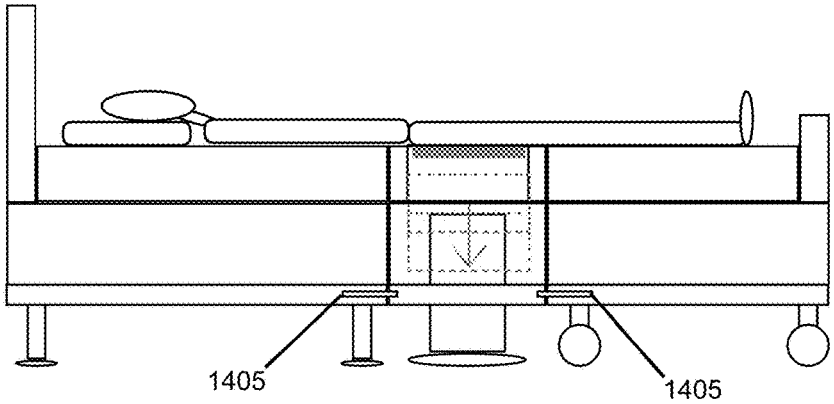
FIG. 14 illustrates an embodiment where the top/torso section, the middle/buttock section, and the bottom/leg section may be connected together.
Figure 16:
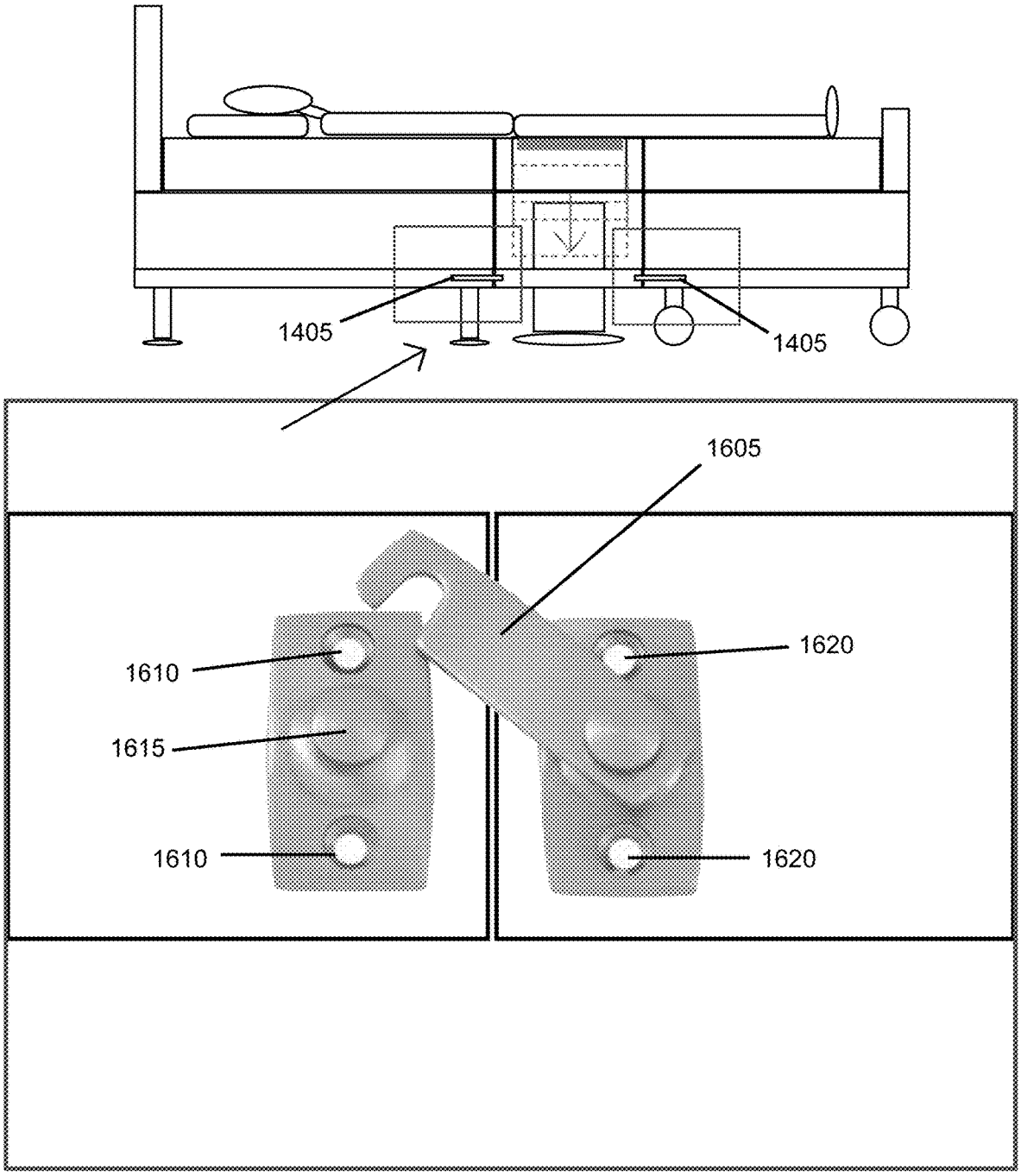
FIG. 16 illustrates an embodiment of securing the bed sections together.

Locks 1405 of FIG. 14 illustrate how the top/torso section 1305, the middle/but section 1310, and the bottom/leg section 1315 may be connected together. The locks 1405 may be disconnected, allowing the sections 1305, 1310 and 1315 to be separated and/or swung out. FIG. 16 illustrates an embodiment of the locks 1405, where two sections of the bed may be latched locked together using a latch 1605 that may be bolted onto a bed using hole 1610, latched around a bolt 1615. Note that other bolts may be used in holes 1620 to connect the latching mechanism to the bed.

Figure 13B:
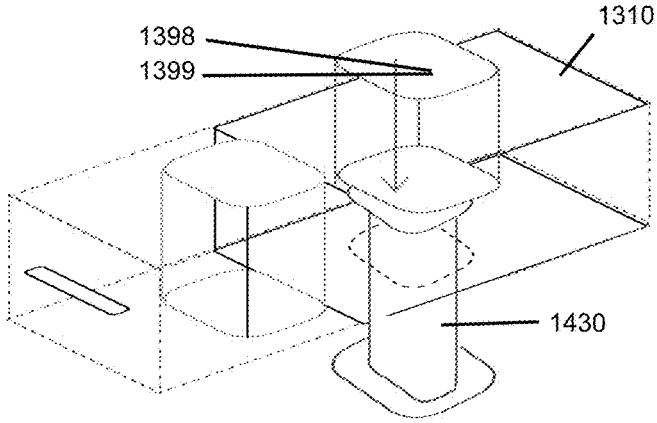
FIGS. 13B and 13C illustrates a component where a support mechanism may be used for raising and lowering a container
Figure 13C:
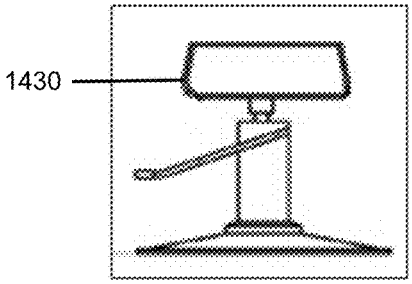

FIGS. 13B and 13C illustrates a component where a support mechanism 1430 may be used for raising and lowering a container (e.g., container 1398/1399) like a barber's chair. A mechanism such as a foot activated pump pedal may be used such as that disclosed in U.S. Pat. No. 957,258, which is herein incorporated by reference. The mechanism may be operated by hydraulics, ratchet mechanics, or compressed air, or any combination thereof. The support mechanism 1430 may be located underneath the cutout of the mattress and also underneath a cutout of the bottom of the drawer so that the container raises to the proper height for supporting the patient's buttocks. It may then lower to the bottom of the drawer were it will slide out when the drawer is pulled out.

Figure 17:
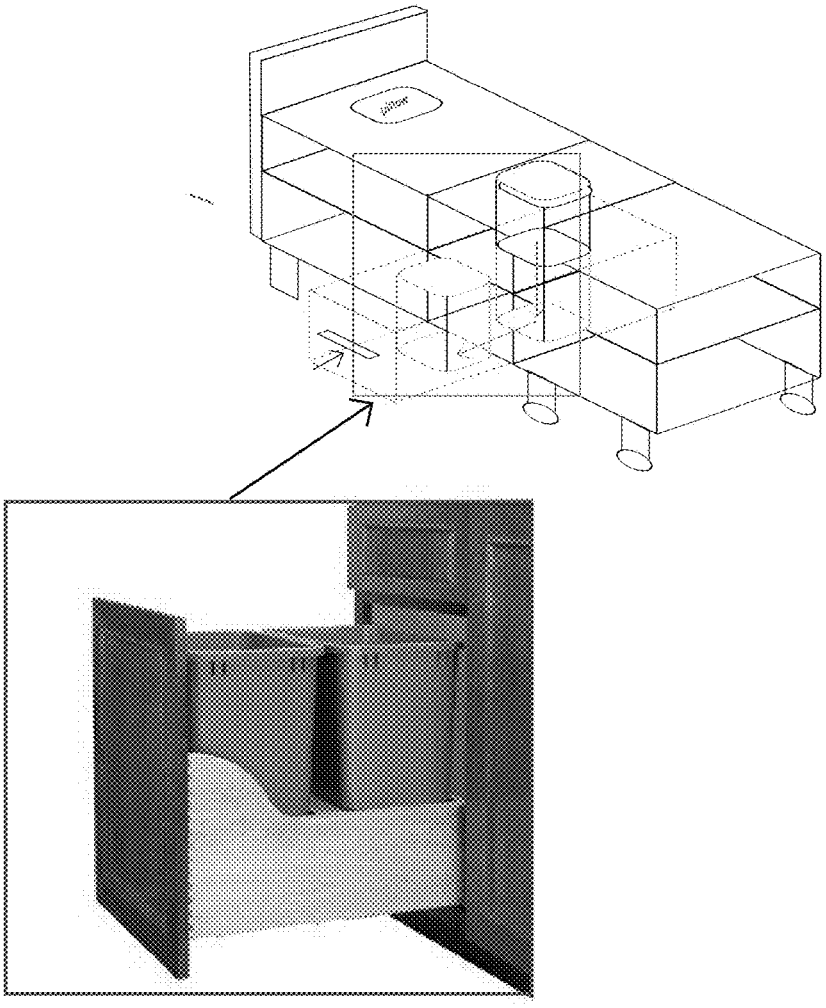
FIG. 17 illustrates an embodiment where the drawer may be on slides.
Figure 17:
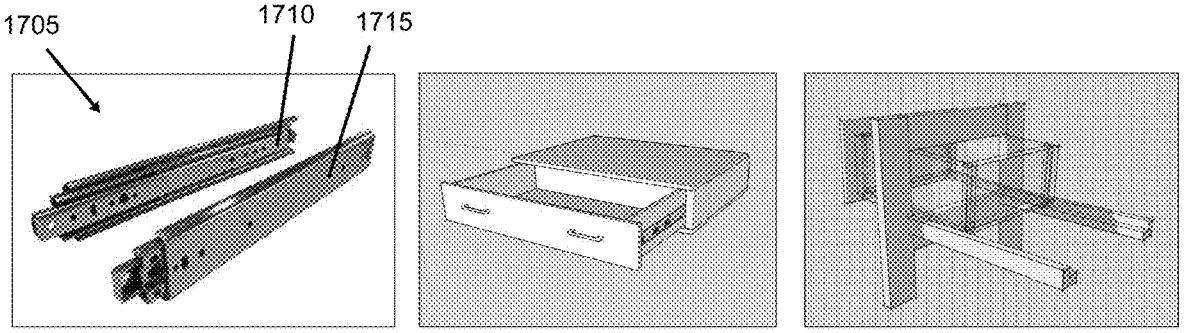

In another embodiment, the container 1398/1399 with or without a diaper pad 1333 may be configured so that it drops down below the mattress area onto a drawer 1330, which may be pulled out for cleaning and/or changing the container, and/or changing the diaper pad 1333. The drawer 1330 may include a handle 1325. Note that the drawer 1330 may be used with a bed divided into three sections, or with a bed that is not divided. FIG. 17 illustrates an embodiment of the drawer 1330, holding the container. (Note that while the diaper pad is not shown in this embodiment, but that it may also be used here.) (Also note that the double container system shown in FIG. 17 may be used or more or fewer containers may be used instead of two. A two container system may provide storage for the bidet/bathing container and a second clean toilet container. In other embodiments, two toilet containers may be used. In a fully automated version, a clean container can be moved into place to replace a soiled container. It may be controlled by a patient and/or care provider. If controlled by the patient, there is no need to wait for a caregiver to change out a soiled container.) The drawer 1330 may slide in an out from under the bed mattress. When the drawer 1330 is closed, it may be "parked" inside the bed primary structure. The opening where the drawer 1330 is inserted may be slightly larger than the drawer 1330, allowing enough room for the drawer 1330 to slip inside. When the handle 1325 is pulled or pushed, the drawer is pulled or pushed along.

FIG. 17 illustrates how the drawer 1330 may be on slides to help the drawer 1330 move more smoothly. The drawer slide 1705 affixed to the drawer 1330 may fit into the portion of the slide that is attached inside the opening. It may be a long narrow mechanism, with the door side sliding in and out of the opening section. The slides may also prevent the drawer 1330 from falling out of the opening by limiting the distance the drawer 1330 may be pulled. The drawer slides 1705 may be made up of two parts, a first part 1710 that fits along the length of the outside of the drawer 1330, and second part 1715 that may fit in the opening for the drawer 1330. Two slides may be used for each drawer 1330, with one slide attached to the each side of the drawer 1330. In some embodiments, more or less slides may also be used. Ball bearing drawer slides may be used (e.g., to support heavier objects).

While various embodiments have been described above, it should be understood that they have been presented by way of example and not limitation. It will be apparent to persons skilled in the relevant art(s) that various changes in form and detail can be made therein without departing from the spirit and scope. In fact, after reading the above description, it will be apparent to one skilled in the relevant art(s) how to implement alternative embodiments.

In addition, it should be understood that any figures that highlight the functionality and advantages are presented for example purposes only. The disclosed methodology and system are each sufficiently flexible and configurable such that they may be utilized in ways other than that shown.

Although the term "at least one" may often be used in the specification, claims and drawings, the terms "a", "an", "the", "said", etc. also signify "at least one" or "the at least one" in the specification, claims and drawings.

Finally, it is the applicant's intent that only claims that include the express language "means for" or "step for" be interpreted under 35 U.S.C. 112(f). Claims that do not expressly include the phrase "means for" or "step for" are not to be interpreted under 35 U.S.C. 112(f).

What is claimed is:

1. A system comprising:

at least one mattress on at least one horizontal support, the at least one mattress configured to receive at least one diaper pad substantially within, underneath, or on top of at least one cut-out portion of the at least one mattress;

at least two vertical supports for supporting the at least one mattress;

at least a part of at least one container stored under the mattress, the at least one container comprising at least one diaper pad support, the at least one diaper pad support comprising at least one upper surface and at least one lower surface, the at least one lower surface in direct contact with the at least one container, the at least one diaper pad support also comprising at least one drainage slat and/or at least one drainage area, the at least one diaper pad support configured for supporting the at least one diaper pad; and at least one drawer element connected to the at least two vertical supports and located underneath the at least one mattress, the at least one drawer element configured to hold the at least one container;

wherein a user of the system is able to urinate or defecate on the diaper pad into the container.

2. The system of claim 1, wherein the at least one drawer element comprises at least one track configured to guide the at least one container.

3. The system of claim 2, wherein the at least one track is L-shaped and guides the at least one container downwardly away from the at least one mattress, and then outwardly to at least one lateral position.

4. The system of claim 1, wherein the at least one container is configured to fit inside and/or underneath the at least one cut-out portion of the at least one mattress.

5. The system of claim 1, wherein at least one diaper pad is configured to rest on top of the at least one diaper pad support.

6. The system of claim 1, wherein the at least one container comprises and/or functions as at least one bidet tub, wherein the at least one bidet tub comprises a shower insert and/or a shower attachment.

7. The system of claim 1, further comprising at least one hand crank configured to either raise or lower the at least one container.

8. The system of claim 1, wherein the height of the at least one mattress is adjustable either upwardly or downwardly.

9. The system of claim 1, wherein the at least one horizontal support and/or the at least one mattress are/is divided into a torso section, a middle section, and a leg section.

10. The system of claim 9, wherein any of the torso section, the middle section and the leg section are detachable and/or removable.

11. The system of claim 1, further comprising:

at least one movable pillar unit for supporting the at least one container.

12. The system of claim 11, wherein the at least one container is shaped to fit inside and/or within the at least one movable pillar unit.

13. The system of claim 1, wherein the at least one container is shaped to fit inside and/or underneath the at least one mattress; and/or inside or within the drawer element configured to hold the at least one container.

14. The system of claim 6, further comprising at least one water tank that fits underneath, within, or near the mattress that is a water source for bathing and/or washing the user of the system.

15. The system of claim 1, further comprising a at least one fluid sensor.

16. The system of claim 1, wherein the at least one container and/or the at least one diaper pad is configured to drop down and slide out for cleaning.

17. A system comprising:

at least two vertical supports for supporting at least one mattress, the at least one mattress configured to receive at least one diaper pad substantially within, underneath, or on top of at least one cut-out portion of the at least one mattress; and at least one drawer element connected to the vertical supports and located underneath the mattress, the at least one drawer element configured to hold at least one container, the at least one container comprising at least one diaper pad support, the at least one diaper pad support comprising at least one upper surface and at least one lower surface, the at least one lower surface in direct contact with the at least one container, the at least one diaper pad support also comprising at least one drainage slat and/or at least one drainage area, the at least one diaper pad support configured for supporting the at least one diaper pad;

wherein a user of the system is able to urinate or defecate on the diaper pad into the container.

18. The system of claim 17, further comprising:

at least one movable pillar unit for supporting the at least one container.

19. The system of claim 17, wherein the at least one container is movable and comprises: at least one toilet container, at least one bidet and/or shower container, or at least one shower insert, or any combination thereof.

20. The system of claim 17, wherein the at least one container is shaped to fit inside and/or underneath the at least one mattress.

21. The system of claim 13, further comprising:

at least one actuator integrated with the at least one movable pillar unit that is configured to raise and/or lower the at least one container.

22. The system of claim 19, further comprising at least one water tank that fits underneath, within, or near the mattress that is a water source for bathing and/or washing the user of the system.

23. The system of claim 17, further comprising a at least one fluid sensor.

24. The system of claim 17, wherein the at least one container and/or the at least one diaper pad is configured to drop down and slide out for cleaning.

* * * * *